US011415925B2

(12) United States Patent
Izumichi et al.

(10) Patent No.: US 11,415,925 B2
(45) Date of Patent: Aug. 16, 2022

(54) SHEET CONVEYANCE DEVICE AND IMAGE FORMING SYSTEM

(71) Applicant: KYOCERA Document Solutions Inc., Osaka (JP)

(72) Inventors: Sachio Izumichi, Osaka (JP); Takuya Nishimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 231 days.

(21) Appl. No.: 16/880,468

(22) Filed: May 21, 2020

(65) Prior Publication Data

US 2020/0371466 A1 Nov. 26, 2020

(30) Foreign Application Priority Data

May 24, 2019 (JP) ..... JP2019-097869

(51) Int. Cl.

| | |
|---|---|
| ***B65H 43/08*** | (2006.01) |
| ***B65H 43/04*** | (2006.01) |
| ***B65H 29/62*** | (2006.01) |
| ***G03G 15/00*** | (2006.01) |
| ***B65H 5/08*** | (2006.01) |
| ***B65H 5/06*** | (2006.01) |

(52) U.S. Cl.

CPC ..... *G03G 15/6552* (2013.01); *B65H 5/062* (2013.01); *B65H 5/085* (2013.01)

(58) Field of Classification Search

CPC ..... B65H 2511/528; B65H 2511/51; B65H 2511/515; B65H 2601/111; B65H 2601/11; B65H 5/062; B65H 43/04; B65H 29/62; B65H 29/60; G03G 15/6552; G03G 15/70; G03G 15/5012; G03G 2215/00552

See application file for complete search history.

(56) References Cited

U.S. PATENT DOCUMENTS

| | | | | |
|---|---|---|---|---|
| 2018/0210389 | A1* | 7/2018 | Konishi | G06F 3/1234 |
| 2018/0215177 | A1* | 8/2018 | Jariabka | B41J 13/0036 |
| 2019/0161311 | A1* | 5/2019 | Takahashi | B65H 29/58 |
| 2019/0332337 | A1* | 10/2019 | Matsumae | G06F 3/1207 |
| 2021/0034005 | A1* | 2/2021 | Han | G03G 15/50 |

FOREIGN PATENT DOCUMENTS

JP 2019-052031 A 4/2019

* cited by examiner

*Primary Examiner* — Luis A Gonzalez

(74) *Attorney, Agent, or Firm* — Studebaker & Brackett PC

(57) ABSTRACT

A sheet conveyance device includes a sheet receiving part, a first discharge part, a sheet conveyance path, an escape conveyance path, a branch guide, an escape tray, a second discharge part, and a first sheet detection part. When a device failure occurs, the branch guide switches the conveyance direction such that the sheet remaining on the sheet conveyance path is discharged on the escape tray by the second discharge part, through the escape conveyance path sequentially. Then, the second discharge part stops a discharging of the sheet in a state where the sheet remains in the second discharge part when the sheet is a last sheet to be conveyed to the escape tray. Then, a receiving of a new sheet to the sheet receiving part from the image forming apparatus is inhibited while the first sheet detection part detects the last sheet.

9 Claims, 3 Drawing Sheets

SHEET CONVEYANCE DEVICE AND IMAGE FORMING SYSTEM

INCORPORATION BY REFERENCE

This application is based on and claims the benefit of priority from Japanese patent application No. 2019-097869 filed on May 24, 2019, which is incorporated by reference in its entirety.

BACKGROUND

The present disclosure relates to a sheet conveyance device and an image forming system including the sheet conveyance device.

In the sheet conveyance device, a conveyance path along which a sheet is conveyed is formed. When a sheet conveyance failure (hereinafter, called "a sheet jam") occurs on the conveyance path, receiving of the sheet to the conveyance path is temporarily stopped, and after an operator, such as a user or a service man, removes the sheet jammed in the conveyance path, the receiving of the sheet to the conveyance path is restarted.

In a case where a relatively long sheet conveyance path is formed in the sheet conveyance device, when the receiving of the sheet is stopped owing to the occurrence of the sheet jam, some sheets remains on the conveyance path. If the operator removes the sheets remaining on the conveyance path one by one, it is necessary for the operator to carry out a jam treatment work frequently.

Then, the sheet conveyance device is sometimes provided with an escape tray to which the sheet remaining on the conveyance path is temporarily escaped.

The above escape tray is for escaping the sheets remaining on the conveyance path temporarily, and is not usually configured to store a large amount of the sheets. Thereby, when the receiving of the sheet is restarted under a state where the sheets remains on the escape tray and the sheet jam occurs again, the sheets more than an allowable number may be discharged on the escape tray, and then the paper jam may occur at the escape tray or its periphery.

SUMMARY

In accordance with an aspect of the present disclosure, a sheet conveyance device receiving a sheet discharged from an image forming apparatus and discharging the sheet to a post processing device, includes an apparatus main body, a sheet receiving part, a first discharge part, a sheet conveyance path, an escape conveyance path, a branch guide, an escape tray, a second discharge part, and a first sheet detection part. The sheet receiving part is provided in the apparatus main body and receives the sheet from the image forming apparatus. The first discharge part is provided in the apparatus main body and discharges the sheet received to the sheet receiving part. Along the sheet conveyance path, the sheet is conveyed from the sheet receiving part to the first discharge part in a predetermined conveyance direction. The sheet conveyance path is provided in the apparatus main body. The escape conveyance path is branched from the sheet conveyance path at a branch part on an upstream side of the first discharge part in the conveyance direction. The branch guide is provided at the branch part and switches the conveyance direction of the sheet. The escape tray is connected to the escape conveyance path. On the escape tray, the sheet conveyed along the escape conveyance path is stacked. The second discharge part is located on an end of the escape conveyance path to discharge the sheet to the escape tray. The first sheet detection part detects the sheet stacked on the escape tray. When a device failure occurs in the post processing device during conveying the sheet, the branch guide switches the conveyance direction such that the sheet remaining on the sheet conveyance path is discharged on the escape tray by the second discharge part, through the escape conveyance path sequentially. Then, the second discharge part stops a discharging of the sheet in a state where a rear end portion of the sheet remains in the second discharge part when the sheet is a last sheet to be conveyed to the escape tray. Then, a receiving of a new sheet to the sheet receiving part from the image forming apparatus is inhibited while the first sheet detection part detects the last sheet.

In accordance with one aspect of the present disclosure, an image forming system includes an image forming apparatus forming an image on a sheet, a post processing device performing a post processing on the sheet on which the image is formed by the image forming apparatus, and the post processing device. The image forming system includes a controller controlling a conveyance of the sheet; and a display part displaying an error screen reporting the device failure that is occurring. When the device failure occurs on the post processing device, the controller displays the error screen on the display part and controls the sheet conveyance device to stop a discharging of the sheet from the first discharge part and to escape the sheet, which remains on the sheet conveyance path on an upstream side of the branch part in the conveyance direction, to the escape tray. When the sheet is removed from the escape tray and the first sheet detection part no longer detects the sheet, the controller allows the sheet conveyance device to restart a conveyance of the sheets.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
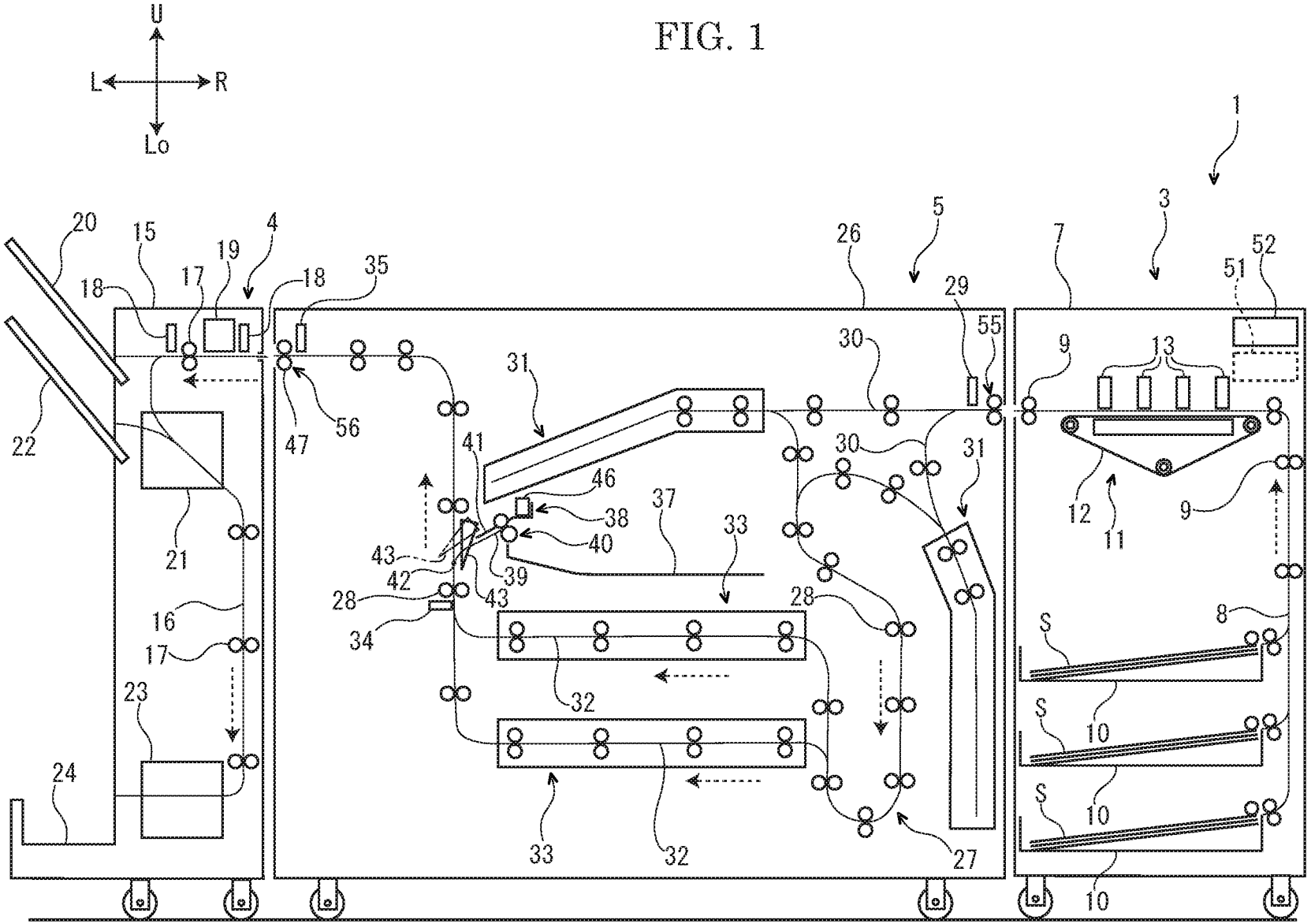
FIG. 1 is a front view schematically showing an image forming system including a sheet conveyance device according to one embodiment of the present disclosure.

Hereinafter, a sheet conveyance device 5 according to the embodiment of the present invention will be described with reference to the drawings. In the following description, for convenience for explanation, a front side on a paper surface of FIG. 1 is defined as a front side of the sheet conveyance device 5. Arrows L, R, U and Lo marked in FIG. 2 respectively show a left side, a right side, an upper side and a lower side of the sheet conveyance device 5.

Hereinafter, "an upstream (side)" and "a downstream (side)" in the following description show "an upstream (side)" and "a downstream (side)" in a sheet conveyance direction (refer to the dotted line arrow in FIG. 1 and FIG. 2) in the sheet conveyance device 5.

With reference to FIG. 1, the image forming system 1 includes an image forming apparatus 3 which forms an image on a sheet S, a post processing device 4 which performs a post processing on the sheet S on which the image has been formed by the image forming apparatus 3, and a sheet conveyance device 5 which conveys the sheet S from the image forming apparatus 3 to the post processing device 4.

Firstly, a configuration of the image forming apparatus 3 will be described.

With reference to FIG. 1, the image forming apparatus 3 includes a first housing 7. Inside the first housing 7, a first conveyance path 8 along which the sheet S is conveyed is provided. On the first conveyance path 8, first rollers pairs 9 are provided at intervals in the sheet conveyance direction. At the upstream end portion of the first conveyance path 8, a plurality of sheet feeding cassettes 10 which stores the sheet S is provided. In the midstream portion of the first conveyance path 8, an inkjet type image forming part 11 is provided. The image forming part 11 includes a conveyance belt 12 and a plurality of recording heads 13.

Next, an operation of the image forming apparatus 3 will be described.

The sheet S picked up from each sheet feeding cassette 10 is conveyed to the downstream side along the first conveyance path 8 of the image forming apparatus 3 by the first conveyance rollers pairs 9, and then sucked to the upper face of the conveyance belt 12. The recording heads 13 eject inks on the sheet S sucked to the upper face of the conveyance belt 12. Then, an image is formed on the sheet S. The sheet S on which the image has been formed is further conveyed to the downstream side along the first conveyance path 8 by the first conveyance rollers pairs 9, and then discharged from the downstream end portion of the first conveyance path 8.

Next, a configuration of the post processing device 4 will be described.

With reference to FIG. 1, the post processing device 4 includes a second housing 15. Inside the second housing 15, a second conveyance path 16 along which the sheet S is conveyed is provided. On the second conveyance path 16, second conveyance rollers pairs 17 are provided at intervals in the sheet conveyance direction. On the second conveyance path 16, sheet sensors 18 are provided at intervals in the sheet conveyance direction. Each sheet sensor 18 detects the sheet S passing through the second conveyance path 16. In the upstream portion of the second conveyance path 16, a punching mechanism 19 and a discharge tray 20 are provided. In the midstream portion of the second conveyance path 16, a staple mechanism 21 and a discharge tray 22 are provided. In the downstream portion of the second conveyance path 16, a sheet folding mechanism 23 and a discharge tray 24 are provided.

Next, an operation of the post processing device 4 will be described.

The sheet S on which the image has been formed in the image forming apparatus 3 is discharged to the post processing device 4 from the sheet conveyance device 5 (described later in detail), and then enters the upstream portion of the second conveyance path 16 of the post processing device 4. The punching mechanism 19 performs a punching processing on the sheet S entered the upstream portion of the second conveyance path 16 as required. The sheet S passed through the punching mechanism 19 is discharged on the discharge tray 20 or further conveyed to the downstream side along the second conveyance path 16 by the second conveyance rollers pairs 17 and then reaches the midstream portion of the second conveyance path 16. The staple mechanism 21 performs a staple processing on the sheet S reached the midstream portion of the second conveyance path 16 as required. The sheet S passed through the staple mechanism 21 is discharged on the discharge tray 22 or further conveyed to the downstream side along the second conveyance path 16 by the second conveyance rollers pairs 17 and then reaches the downstream portion of the second conveyance path 16. The sheet folding mechanism 23 performs a folding processing on the sheet S reached the downstream portion of the second conveyance path 16 as required. The sheet S passed through the sheet folding mechanism 23 is discharged on the discharge tray 24.

Next, a configuration of the sheet conveyance device 5 will be described.

With reference to FIG. 1, the sheet conveyance device 5 is provided separately from the image forming apparatus 3 and the post processing device 4, and detachably coupled to the image forming apparatus 3 and the post processing device 4.

The sheet conveyance device 5 includes a third housing 26 (an example of an apparatus main body). Inside the third housing 26, a third conveyance path 27 (an example of a sheet conveyance path) is provided, along which the sheet S is conveyed from a sheet receiving part 55 to a first discharge part 56. On the third conveyance path 27, third conveyance rollers pairs 28 are provided at intervals in the sheet conveyance direction. At the upstream end portion of the third conveyance path 27, the sheet receiving part 55 and an inlet sensor 29 are provided. Through the sheet receiving part 55, the sheet S is received to the third conveyance path 27. The inlet sensor 29 detects the sheet S received to the upstream end portion of the third conveyance path 27. In the upstream portion of the third conveyance path 27, a pair of upstream side branch paths 30 is provided. Each upstream side branch path 30 includes a reversion unit 31. In the downstream portion of the third conveyance path 27, a pair of downstream side branch paths 32 is provided. Each downstream side branch path 32 includes a correction unit 33. In the downstream portion of the third conveyance path 27, a second sheet sensor 34 (an example of a second sheet detection part) is provided on a downstream side of each downstream side branch path 32. The second sheet sensor 34 detects the sheet S passed through the third conveyance path 27. At the downstream end portion of the third conveyance path 27, the first discharge part 56 and an outlet sensor 35 are provided. The first discharge part 56 includes a first discharge rollers pair 47 discharging the sheet S from the third conveyance path 27. The outlet sensor 35 detects the sheet S discharged from the downstream end portion of the third conveyance path 27.

Next, an operation of the sheet conveyance device 5 will be described.

The sheet S on which the image has been formed in the image forming apparatus 3 is discharged from the image forming apparatus 3, and then enters the third conveyance path 27 of the sheet conveyance device 5. The sheet S entered the third conveyance path 27 is conveyed to one of the upstream side branch paths 30. Each reversion unit 31 reverses the front and back sides of the sheet S entered the upstream side branch path 30. The sheet S of which front and back sides are reversed is further conveyed to a downstream side along the third conveyance path 27 by the third conveyance rollers pairs 28, and then enters one of the downstream side branch paths 32. Each correction unit 33 corrects a position of the sheet S entered the downstream side branch path 32 in the front-and-rear direction (a sheet width direction perpendicular to the sheet conveyance direction). The sheet S of which position is corrected in the front-and-rear direction is further conveyed to a downstream side along the third conveyance path 27 by the third conveyance rollers pairs 28, and then discharged from the downstream end portion of the third conveyance path 27.

Next, a main section of the sheet conveyance device 5 will be further described.

Figure 2:
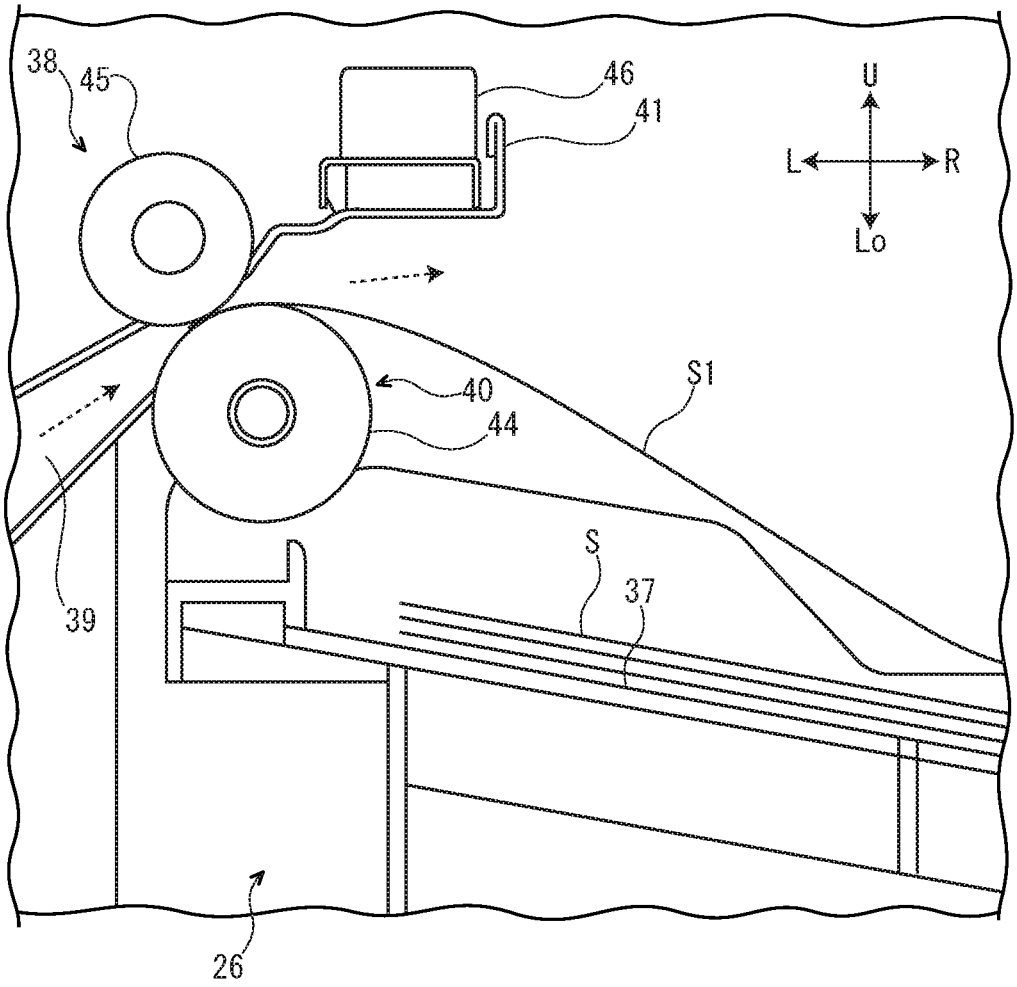
FIG. 2 is a front view showing a main section of the sheet conveyance device according to the embodiment of the present disclosure.

With reference to FIG. 1 and FIG. 2, in the center portion of the third housing 26 of the sheet conveyance device 5, an escape tray 37 on which the sheet S is stacked is provided. The escape tray 37 is provided inside the third housing 26, and does not protrude outside the third housing 26. The front portion of the escape tray 37 is covered with an openable and closable front cover (not shown).

In the left side portion of the third housing 26 of the sheet conveyance device 5, an escape conveyance path 39 branched at a branch part 42 from the third conveyance path 27 of the sheet conveyance device 5 is provided. The downstream end portion of the escape conveyance path 39 is connected to the escape tray 37.

At the branch part 42 between the third conveyance path 27 and the escape conveyance path 39 of the sheet conveyance device 5, a branch guide 43 is provided. The branch guide 43 is switchable between a first posture (refer to the solid line in FIG. 1) where it guides the sheet S to the downstream end portion of the third conveyance path 27 and a second posture (refer to the two-dotted chain line in FIG. 1) where it guides the sheet S to the escape conveyance path 39.

In the left side portion of the third housing 26 of the sheet conveyance device 5, a second discharge part 38 discharging the sheet S to the escape tray 37 through the escape conveyance path 39 of the sheet conveyance device 5 is provided. The second discharge part 38 includes a second discharge rollers pair 40 (an example of a discharge rollers pair) provided on the escape conveyance path 39 and a discharge guide 41 covering the upper space of the escape conveyance path 39.

The second discharge rollers pair 40 of the second discharge part 38 is adjacently disposed on a left side (the upstream side) of the escape tray 37. The second discharge rollers pair 40 includes a lower roller 44 and an upper roller 45 disposed above the lower roller 44. The right side portion of the lower roller 44 is disposed just above the left end portion of the escape tray 37.

The discharge guide 41 of the second discharge part 38 extends from the left side (the upstream side) of the second discharge rollers pair 40 to the right side (the downstream side). To the right side portion of the discharge guide 41, a first sheet sensor 46 (an example of a first sheet detection part) is attached. The first sheet sensor 46 is disposed on a right side (the downstream side) of the second discharge rollers pair 40. The first sheet sensor 46 is constituted by a reflection type sensor, for example. The first sheet sensor 46 detects the sheet S whose upstream end portion (tail end portion) is nipped by the second discharge rollers pair 40. That is, the first sheet sensor 46 detects the sheet S stacked on the escape tray 37.

Next, a control system of the sheet conveyance device 5 will be described.

With reference to FIG. 1, the image forming apparatus 3 includes a controller 51. The controller 51 is constituted by a Central Processing Unit (CPU), for example. The controller 51 is connected to each sheet sensor 18 of the post processing device 4, the inlet sensor 29, the second sheet sensor 34, the outlet sensor 35 and the first sheet sensor 46 of the sheet conveyance device 5, and receives the detection signals output from those sensors. The controller 51 is connected to each first conveyance rollers pair 9 of the image forming apparatus 3, each second conveyance rollers pair 17 of the post processing device 4, and each third conveyance rollers pair 28 and the second discharge rollers pair 40 of the sheet conveyance device 5 via a driving source (not shown) containing a motor, and controls these rollers pairs to be driven. That is, the controller 51 controls the conveyance of the sheet S on the first conveyance path 8 of the image forming apparatus 3, the second conveyance path 16 of the post processing device 4 and the third conveyance path 27 of the sheet conveyance device 5. The controller 51 is connected to the branch guide 43 via a driving part (not shown) containing a motor or a solenoid, and controls the posture of the branch guide 43.

The image forming apparatus 3 includes a display part 52. The display part 52 is constituted by a liquid crystal display, for example. The display part 52 is connected to the controller 51, and displays various screens (for example, an input screen or an error screen) based on a control signal from the controller 51.

Figure 3:
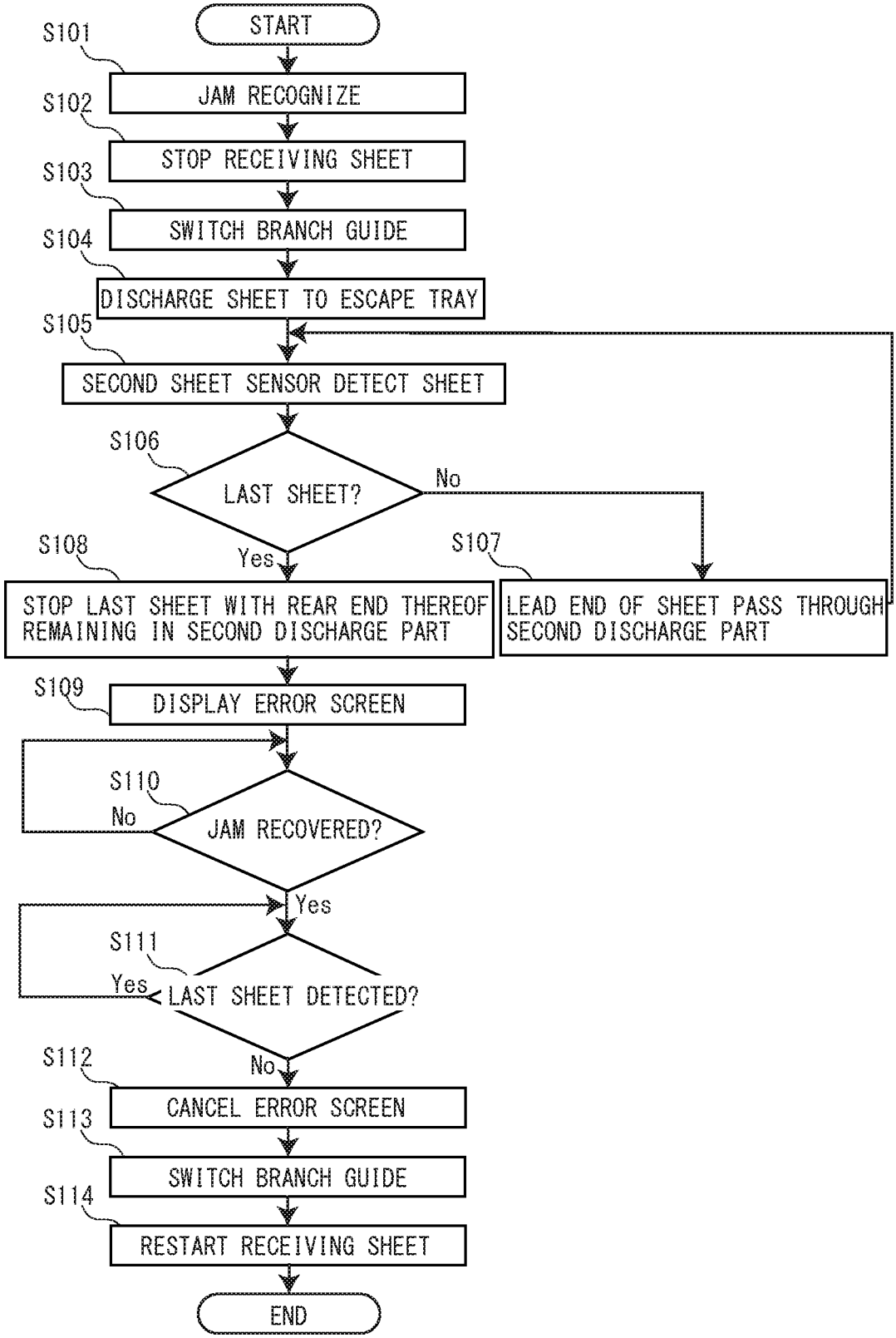
FIG. 3 is a flowchart showing a control in a case where a sheet conveyance failure occurs on a second conveyance path of a post processing device, in the sheet conveyance device according to the embodiment of the present disclosure.

Next, with reference to FIG. 3, a control in a case where a sheet conveyance failure (hereinafter, called "a sheet jam" or "a device failure") occurs on the second conveyance path 16 of the post processing device 4 will be described.

When the sheet jam occurs on the second conveyance path 16 of the post processing device 4, the controller 51 recognizes that the sheet jam occurs on the second conveyance path 16 of the post processing device 4 based on a detection signal output from the sheet sensors 18 of the post processing device 4 (step S101). For example, when any one of the sheet sensors 18 continuously detects the sheet S for a predetermined time period or more, the controller 51 recognizes that the sheet jam occurs on the second conveyance path 16 of the post processing device 4.

In such a case, the controller 51 stops the first conveyance rollers pairs 9 of the image forming apparatus 3, the second conveyance rollers pairs 17 of the post processing device 4 and the third conveyance rollers pairs 28 of the sheet conveyance device 5. Then, the conveyance of the sheet S along the first conveyance path 8 of the image forming apparatus 3, the second conveyance path 16 of the post processing device 4 and the third conveyance path 27 of the sheet conveyance device 5 is temporarily stopped. Then, receiving of a new sheet S to the third conveyance path 27 is temporarily stopped (step S102).

Next, the controller 51 switches the branch guide 43 of the sheet conveyance device 5 from the first posture (refer to the solid line in FIG. 1) to the second posture (refer to the two-dotted chain line in FIG. 1) (step S103).

Next, the controller 51 drives the first conveyance rollers pairs 9 of the image forming apparatus 3, the third conveyance rollers pairs 28 and the second discharge rollers pair 40 of the sheet conveyance device 5. Then, the sheet S is conveyed from the first conveyance path 8 of the image forming apparatus 3 to the third conveyance path 27 of the sheet conveyance device 5 by the first conveyance rollers pairs 9 of the image forming apparatus 3. Additionally, the sheets S remaining on the third conveyance path 27 of the sheet conveyance device 5 are sequentially discharged to the escape tray 37 through the escape conveyance path 39 by the third conveyance rollers pairs 28 and the second discharge rollers pair 40 of the sheet conveyance device 5 (step S104).

When the sheets S remaining on the third conveyance path 27 of the sheet conveyance device 5 are sequentially discharged to the escape tray 37 through the escape conveyance path 39 in the above manner, the second sheet sensor 34 of the sheet conveyance device 5 detects the upstream end portion of the sheet S passing through the third conveyance path 27 of the sheet conveyance device 5 (step S105).

For each time when the second sheet sensor 34 of the sheet conveyance device 5 detects the upstream end portion of the sheet S passing through the third conveyance path 27 of the sheet conveyance device 5, the controller 51 determines whether the sheet S is the last sheet S conveyed to the escape tray 37 through the escape conveyance path 39 of the sheet conveyance device 5 (hereinafter, called "the last sheet S1" simply) (step S106). The determination is performed as follows, for example.

Firstly, the controller 51 calculates a number of the sheet S conveyed to the escape tray 37 through the escape conveyance path 39 of the sheet conveyance device 5 (hereinafter, called "a number of the escaped sheets") by subtracting a number of the sheets S detected by the outlet sensor 35 of the sheet conveyance device 5 for a predetermined time period from a number of the sheets S detected by the inlet sensor 29 of the sheet conveyance device 5 for the predetermined time period. Then, the controller 51 determines that the sheet S detected by the second sheet sensor 34 of the sheet conveyance device 5 is not the last sheet S1 while a number of the sheet S detected by the second sheet sensor 34 of the sheet conveyance device 5 after the start of the sheet conveyance at step S104 is smaller than a number of the escaped sheets S. On the other hand, when a number of the sheets detected by the second sheet sensor 34 of the sheet conveyance device 5 after the start of the sheet conveyance at step S104 is the same number as a number of the escaped sheets, the controller 51 determines that the sheet S detected by the second sheet sensor 34 of the sheet conveyance device 5 is the last sheet S1.

For example, in a case where a number of the sheets S detected by the inlet sensor 29 of the sheet conveyance device 5 for a predetermined time period is ten (10) and a number of the sheets S detected by the outlet sensor 35 of the sheet conveyance device 5 for the predetermined time period is two (2), the controller 51 subtracts two (2) from ten (10) and calculates a number of the escaped sheets to be eight 88). In this case, the controller 51 determines that the first to seventh sheets S detected by the second sheet sensor 34 of the sheet conveyance device 5 after the start of the sheet conveyance at step S104 are not the last sheet S1, and determines that the eighth sheet S detected by the second sheet sensor 34 of the sheet conveyance device 5 after the start of the sheet conveyance at step S104 is the last sheet S1.

In a case where the determination at step S106 is No (the case where the controller 51 determines that the sheet passing through the third conveyance path 27 of the sheet conveyance device 5 is not the last sheet S1), the controller 51 continues to drive the first conveyance rollers pairs 9 of the image forming apparatus 3, the third conveyance rollers pairs 28 and the second discharge rollers pair 40 of the sheet conveyance device 5. Thereby, the upstream end portion of the sheet S is passed through the second discharge rollers pair 40 (step S107). While the determination at step S106 is No, step S105 to step S107 are repeated.

On the other hand, in a case where the determination at step S106 is Yes (the case where the controller 51 determines that the sheet S passing the third conveyance path 27 of the sheet conveyance device 5 is the last sheet S1), the controller 51 stops the driving of the first conveyance rollers pairs 9 of the image forming apparatus 3, the third conveyance rollers pairs 28 and the second discharge rollers pair 40 of the sheet conveyance device 5 at a state where the upstream end portion of the last sheet S1 is nipped by the second discharge rollers pair 40 (refer to FIG. 2). That is, the controller 51 stops the last sheet S1 with the upstream end portion remaining in the second discharge part 38 (step S108).

At this time, the controller 51 determines a timing when the last sheet S1 is stopped, based on a time when the second sheet sensor 34 detects the upstream end portion of the last sheet S1. For example, the controller 51 stops the last sheet S1 after T seconds from the time when the second sheet sensor 34 detects the upstream end portion of the last sheet S1.

For example, the controller 51 determines the above T seconds so as to satisfy the following equation.

$$T1<T<T2 \quad (1)$$

T1: a time from when the second sheet sensor 34 detects the upstream end portion of the last sheet S1 until the upstream end portion of the last sheet S1 reaches the nip of the second discharge rollers pair 40, and T2: a time from when the second sheet sensor 34 detects the upstream end portion of the last sheet S1 until the downstream end portion of the last sheet S1 passes through the nip of the second discharge rollers pair 40.

For example, the controller 51 calculates the above T1 and T2 by the following equations (2) and (3).

$$T1=L1/V \quad (2)$$

$$T2=(L1+L2)/V \quad (3)$$

L1: a distance from a sheet detection position of the second sheet sensor 34 to the nip position of the second discharge rollers pair 40, L2: a length of the last sheet S1 in the sheet conveyance direction, and L3: a sheet conveyance speed.

When the processing at step S108 is finished, the controller 51 displays an error screen on the display part 52 (step S109). The error screen shows that the sheet jam occurs on the second conveyance path 16 of the post processing device 4 and the sheet S (containing the last sheet S1) remains on the escape tray 37 of the sheet conveyance device 5.

Next, the controller 51 determines whether the sheet jam on the second conveyance path 16 of the post processing device 4 is eliminated based on the detection signal from each sheet sensor 18 of the post processing device 4 (step S110). For example, the controller 51 determines that the sheet jam on the second conveyance path 16 of the post processing device 4 is eliminated in a case where the sheet sensor 18, which has continuously detected the sheet S for the predetermined time period or more at step S101, no longer detects the sheet S. On the other hand, the controller 51 determines that the sheet jam on the second conveyance path 16 of the post processing device 4 is eliminated in a case where the sheet sensor 18, which has continuously detected the sheet S for the predetermined time period or more at step S101, still detects the sheet S.

Until the operator such as a user or a service man removes the sheet S jammed on the second conveyance path 16 of the post processing device 4, the determination at step S110 is No. In this case, the controller 51 repeats the determination at step S110.

On the other hand, when the operator removes the sheet S jammed on the second conveyance path 16 of the post processing device 4, the determination at step S110 is Yes. In this case, the controller 51 determines whether the first sheet sensor 46 detects the last sheet S1 (step S111).

Until the operator removes the sheet S (containing the last sheet S1) stacked on the escape tray 37 of the sheet conveyance device 5, the determination at step S111 is Yes. In this case, the controller 51 repeats the determination at step S111.

On the other hand, when the operator removes the sheet S (containing the last sheet S1) stacked on the escape tray 37 of the sheet conveyance device 5, the determination at step S111 is No. In this case, the controller 51 controls the display part 52 to cancel the error screen (step S112).

Next, the controller 51 switches the branch guide 43 of the sheet conveyance device 5 from the second posture (refer to the two-dotted chain line in FIG. 1) into the first posture (refer to the solid line in FIG. 1) (step S113).

Next, the controller 51 drives the first conveyance rollers pairs 9 of the image forming apparatus 3, the second conveyance rollers pairs 17 of the post processing device 4 and the third conveyance rollers pairs 28 of the sheet conveyance device 5. Thereby, the conveyance of the sheet S on the first conveyance path 8 of the image forming apparatus 3, the second conveyance path 16 of the post processing device and the third conveyance path 27 of the sheet conveyance device 5 is restarted. Then, the receiving of new sheet S to the third conveyance path 27 is restarted (step S114).

As described above, when the discharging of the sheet S from the first discharge part 56 is inhibited, the controller 51 discharges the sheet S remaining on the third conveyance path 27 of the sheet conveyance device 5 to the escape tray 37 through the third conveyance path 27 of the sheet conveyance device 5 sequentially, and stops the last sheet S1 conveyed to the escape tray 37 from the third conveyance path 27 of the sheet conveyance device 5 with the upstream end portion of the last sheet S1 remaining on the second discharge part 38. Additionally, while the first sheet sensor 46 detects the last sheet S1, the controller 51 stops the receiving of the new sheet S to the third conveyance path 27 of the sheet conveyance device 5. Then, when the discharging of the sheet S from the first discharge part 56 is allowed, if the sheet S stacked on the escape tray 37 is removed and the first sheet sensor 46 no longer detects the last sheet S1, the controller 51 restarts the receiving of the new sheet S from the sheet receiving part 55 to the third conveyance path 27 of the sheet conveyance device 5. By performing the above control, because the receiving of the new sheet S is stopped until the operator removes the sheet S (containing the last sheet S1) discharged on the escape tray 37, it becomes possible to suppress the restarting of the receiving of the new sheet S while the sheet S remaining on the escape tray 37. Therefore, the sheets S larger than an allowable number are suppressed from being discharged on the escape tray 37 so that the occurrence of the sheet jam in the escape tray 37 or its periphery can be prevented.

By performing the above control, it becomes possible to detect the sheet S of various sizes using one first sheet sensor 46 surely. Thereby, there is no need for providing a number of first sheet sensors 46 for each size and it becomes possible to suppress the complication of the configuration of the sheet conveyance device 5.

The second discharge part 38 includes the second discharge rollers pair 40 disposed adjacent to the escape tray 37, and the controller 51 stops the second discharge rollers pair 40 while the upstream end portion of the last sheet S1 nipped in the second discharge rollers pair 40. By performing the above control, the operator easily notices the last sheet S1 so that it forcefully urges the operator to remove the sheet S (containing the last sheet S1) discharged on the escape tray 37.

The first sheet sensor 46 is disposed on a downstream side of the second discharge rollers pair 40. By applying such an arrangement, a space above the escape tray 37 is used to dispose the first sheet sensor 46, so that it becomes possible to obtain an installation space of the first sheet sensor 46 easily.

The controller 51 determines the timing when the last sheet S1 is stopped, based on a time when the second sheet sensor 34 disposed on an upstream side of the branch part 42 detects the last sheet S1. By performing the above control, even if the sheet conveyance speed is relatively high, it becomes possible to stop the last sheet S1 in the second discharge part 38 surely.

The escape tray 37 is provided inside the third housing 26 of the sheet conveyance device 5. By applying such a configuration, the escape tray 37 is disposed as close as possible to the third conveyance path 27 of the sheet conveyance device 5 so that it becomes possible to make a length of the escape conveyance path 39 between the third conveyance path 27 and the escape tray 37 of the sheet conveyance device 5 short (refer to FIG. 1). Accordingly, it becomes possible to decrease a number of the rollers pairs conveying the sheet S along the escape conveyance path 39.

The escape tray 37 is provided in the sheet conveyance device 5, and the controller 51 conveys the sheet S to the escape tray 37 through the escape conveyance path 39 of the sheet conveyance device 5 when the sheet jam occurs on the second conveyance path 16 of the post processing device 4. By performing such a control, when the sheet jam occurs on the second conveyance path 16 of the post processing device 4, the sheets S remaining on the first conveyance path 8 of the image forming apparatus 3 and the third conveyance path 27 of the sheet conveyance device 5 can be escaped to the escape tray 37 so that an amount of the jam treatment works of the operator can be decreased.

The invention claimed is:

1. A sheet conveyance device receiving a sheet discharged from an image forming apparatus and discharging the sheet to a post processing device, the sheet conveyance device comprising:

an apparatus main body;

a sheet receiving part provided in the apparatus main body and receiving the sheet from the image forming apparatus;

a first discharge part provided in the apparatus main body and discharging the sheet received to the sheet receiving part, and;

a sheet conveyance path along which the sheet is conveyed from the sheet receiving part to the first discharge part in a predetermined conveyance direction, the sheet conveyance path being provided in the apparatus main body;

an escape conveyance path branched from the sheet conveyance path at a branch part on an upstream side of the first discharge part in the conveyance direction;

a branch guide provided at the branch part and switching the conveyance direction of the sheet;

an escape tray which is connected to the escape conveyance path and on which the sheet conveyed along the escape conveyance path is stacked;

a second discharge part located on an end of the escape conveyance path to discharge the sheet to the escape tray;

a first sheet detection part detecting the sheet discharged to the escape tray by the second discharge part; and a controller configured to control conveyance of the sheet, wherein when a device failure occurs in the post processing device during conveying the sheet, the controller switches the branch guide such that the sheet remaining on the sheet conveyance path is discharged on the escape tray by the second discharge part, through the escape conveyance path sequentially, stops the second discharge part in a state where a rear end portion of the sheet remains in the second discharge part when the sheet is a last sheet to be conveyed to the escape tray, and inhibits a receiving of a new sheet to the sheet receiving part from the image forming apparatus while the first sheet detection part detects the last sheet whose rear end portion remains in the second discharge part.

2. The sheet conveyance device according to claim 1, wherein when the device failure in the post processing device is recovered, after the sheet stacked on the escape tray is removed and the first sheet detection part no longer detects the sheet, the controller allows the receiving of the new sheet to the sheet receiving part.

3. The sheet conveyance device according to claim 1, wherein the second discharge part includes a discharge rollers pair disposed on an upstream side of the escape tray in the conveyance direction, and the controller stops rotation of the discharge rollers pair in a state where a lead end portion of the last sheet is stacked on the escape tray and the rear end portion of the last sheet is nipped by the discharge rollers pair.

4. The sheet conveyance device according to claim 3, wherein the first sheet detection part is disposed above a downstream side of the discharge rollers pair in the conveyance direction.

5. The sheet conveyance device according to claim 1, further comprising a second sheet detection part disposed on an upstream side of the branch part in the conveyance direction and detecting the sheet passing through the sheet conveyance path, wherein when the second sheet detection part does not detect the sheet within a predetermined time period after the second sheet detection part detects a preceding sheet, the controller determines that the preceding sheet is the last sheet, and stops the second discharge part at a predetermined timing after the second sheet detection part detects a leading edge of the last sheet.

6. The sheet conveyance device according to claim 1, further comprising a pair of correction units connected to the sheet conveyance path in parallel, each of the pair of correction units corrects a position of the sheet in a width direction perpendicular to the conveyance direction, wherein the escape tray and the pair of correction units are arranged side by side in a vertical direction, and the escape tray is located above the pair of correction units.

7. The sheet conveyance device according to claim 1, further comprising a display part displaying an error screen reporting the device failure that is occurring, when the device failure occurs on the post processing device, the controller displays the error screen on the display part, stops a discharging of the sheet from the first discharge part, and escapes the sheet, which remains on the sheet conveyance path on an upstream side of the branch part in the conveyance direction, to the escape tray, and when the sheet is removed from the escape tray and the first sheet detection part no longer detects the sheet, the controller allows a conveyance of the sheets.

8. An image forming system comprising:

an image forming apparatus forming an image on a sheet;

a post processing device performing a post processing on the sheet on which the image is formed by the image forming apparatus; and a sheet conveyance device receiving the sheet discharged from the image forming apparatus and discharging the sheet to the post processing device, wherein the image forming apparatus includes a controller controlling conveyance of the sheet, and the sheet conveyance device includes:

an apparatus main body;

a sheet receiving part provided in the apparatus main body and receiving the sheet from the image forming apparatus;

a first discharge part provided in the apparatus main body and discharging the sheet received to the sheet receiving part;

a sheet conveyance path along which the sheet is conveyed from the sheet receiving part to the first discharge part in a predetermined conveyance direction, the sheet conveyance path being provided in the apparatus main body;

an escape conveyance path branched from the sheet conveyance path at a branch part on an upstream side of the first discharge part in the conveyance direction;

a branch guide provided at the branch part and switching the conveyance direction of the sheet;

an escape tray which is connected to the escape conveyance path and on which the sheet conveyed along the escape conveyance path is stacked;

a second discharge part located on an end of the escape conveyance path to discharge the sheet to the escape tray; and a first sheet detection part detecting the sheet discharged to the escape tray by the second discharge part, wherein when a device failure occurs in the post processing device during conveying the sheet, the controller switches the branch guide such that the sheet remaining on the sheet conveyance path is discharged on the escape tray by the second discharge part, through the escape conveyance path sequentially, stops the second discharge part in a state where a rear end portion of the sheet remains in the second discharge part when the sheet is a last sheet to be conveyed to the escape tray, and inhibits a receiving of a new sheet to the sheet receiving part from the image forming apparatus while the first sheet detection part detects the last sheet whose rear end portion remains in the second discharge part.

9. The image forming system according to claim 8, wherein the image forming apparatus includes a display part displaying an error screen reporting the device failure that is occurring, when the device failure occurs on the post processing device, the controller displays the error screen on the display part, stops a discharging of the sheet from the first discharge part, and escapes the sheet, which remains on the sheet conveyance path on an upstream side of the branch part in the conveyance direction, to the escape tray, and when the sheet is removed from the escape tray and the first sheet detection part no longer detects the sheet, the controller allows a conveyance of the sheets.

* * * * *